US009238976B2

(12) United States Patent
Ahmad et al.

(10) Patent No.: US 9,238,976 B2
(45) Date of Patent: Jan. 19, 2016

(54) GUIDE VANE SYSTEM FOR A TURBOMACHINE HAVING SEGMENTED GUIDE VANE CARRIERS

(75) Inventors: Fathi Ahmad, Kaarst (DE); Giuseppe Gaio, Bonn (DE); Holger Grote, Mülheim (DE); Christian Lerner, Dorsten (DE); Mirko Milazar, Oberhausen (DE); Mathias Stutt, Gladbeck (DE); Thomas-Dieter Tenrahm, Dinslaken (DE); Bernd Vonnemann, Gladbeck (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 902 days.

(21) Appl. No.: 13/145,353

(22) PCT Filed: Jan. 5, 2010

(86) PCT No.: PCT/EP2010/050024

§ 371 (c)(1), (2), (4) Date: Oct. 26, 2011

(87) PCT Pub. No.: WO2010/084028

PCT Pub. Date: Jul. 29, 2010

(65) Prior Publication Data

US 2012/0039716 A1 Feb. 16, 2012

(30) Foreign Application Priority Data

Jan. 21, 2009 (EP) ..... 0900797

(51) Int. Cl.
*F01D 9/04* (2006.01)
*F01D 25/24* (2006.01)

(52) U.S. Cl.
CPC ..... *F01D 25/246* (2013.01); *F05D 2230/80* (2013.01)

(58) Field of Classification Search
CPC ..... F01D 11/005; F01D 9/02; F01D 9/023; F01D 9/041; F01D 9/042; F01D 5/225; F01D 25/246
USPC ..... 415/191, 199.5, 209.2, 209.3, 209.4, 415/210.1, 213.1
See application file for complete search history.

(56) References Cited

U.S. PATENT DOCUMENTS 2,766,963 A * 10/1956 Zimmerman ..... 415/209.1
2,851,246 A * 9/1958 Nichols ..... 415/136

(Continued)

FOREIGN PATENT DOCUMENTS

CN 1537212 A 10/2004
EP 1840337 A1 10/2007

(Continued)

*Primary Examiner* — Craig Kim
*Assistant Examiner* — Kayla McCaffrey

(57) ABSTRACT

A turbine guide vane system, in particular for a gas turbine is provided. The turbine guide vane system includes a number of guide vane rows and a guide vane carrier, to enable particularly simple replacement of guide vanes, while maintaining a particularly high degree of efficiency, and thus designed for particularly short repair durations. For this purpose, the guide vane carrier has a number of segments, wherein a segment extends over the entire radial extension of the guide vane carrier and the connection of the remaining segments may be detached, and wherein the turbine guide vane carrier includes at least two sections along the axial extension thereof that are connected to one another and have a different number of segments.

9 Claims, 6 Drawing Sheets

(56) References Cited

U.S. PATENT DOCUMENTS

| | | | | |
|---|---|---|---|---|
| 3,300,180 | A * | 1/1967 | Tuttle et al. | 415/138 |
| 3,302,926 | A * | 2/1967 | Bobo | 415/209.2 |
| 4,083,648 | A | 4/1978 | Asplund | |
| 4,396,349 | A * | 8/1983 | Hueber | 415/115 |
| 4,511,306 | A * | 4/1985 | Hultgren | 415/136 |
| 6,189,211 | B1 * | 2/2001 | Suter | 29/889.1 |
| 6,503,051 | B2 * | 1/2003 | Predmore | 415/135 |
| 6,890,151 | B2 * | 5/2005 | Bertrand et al. | 415/209.2 |
| 7,094,025 | B2 * | 8/2006 | Arness et al. | 415/189 |
| 8,469,662 | B2 * | 6/2013 | Lebrun et al. | 415/209.4 |
| 2004/0067131 | A1 * | 4/2004 | Joslin | 415/139 |
| 2005/0132707 | A1 | 6/2005 | Gebhardt | |
| 2006/0032236 | A1 | 2/2006 | Aumont et al. | |
| 2008/0279679 | A1 * | 11/2008 | Morrison | 415/191 |

FOREIGN PATENT DOCUMENTS

| | | | |
|---|---|---|---|
| GB | 1427915 | A | 3/1976 |
| GB | 2240822 | A | 8/1991 |
| WO | WO 2008012195 | A1 | 1/2008 |

* cited by examiner

GUIDE VANE SYSTEM FOR A TURBOMACHINE HAVING SEGMENTED GUIDE VANE CARRIERS

CROSS REFERENCE TO RELATED APPLICATIONS

This application is the US National Stage of International Application No. PCT/EP2008/050024, filed Jan. 5, 2010 and claims the benefit thereof. The International Application claims the benefits of European Patent Office application No. 09000797.2 EP filed Jan. 21, 2009. All of the applications are incorporated by reference herein in their entirety.

FIELD OF INVENTION

The invention refers to a turbine stator blade carrier, especially for a stationary gas turbine.

BACKGROUND OF INVENTION

Gas turbines are used in many fields for driving generators or driven machines. In this case, the energy content of a fuel is used for producing a rotational movement of a turbine shaft. To this end, the fuel is combusted in a combustion chamber, wherein compressed air is supplied from an air compressor. The operating medium, which is produced in the combustion chamber as a result of combustion of the fuel, is directed in this case under high pressure and under high temperature via a turbine unit, which is connected downstream to the combustion chamber, where it is expanded, performing work.

For producing the rotational movement of the turbine shaft, in this case a number of rotor blades, which are customarily assembled into blade groups or blade rows, are arranged on this and drive the turbine shaft via an impulse transfer from the operating medium. For flow guiding of the operating medium, moreover, stator blades, which are connected to the turbine casing and assembled to form stator blade rows, are customarily arranged between adjacent rotor blade rows. These stator blades are fastened via a blade root on a customarily hollow cylindrical or hollow conical stator blade carrier and on their side facing the turbine axis are fastened via a blade tip on an inner ring which is common to the respective stator blade row. In the case of stationary gas turbines, this inner ring frequently consists of an upper and a lower half which are interconnected via flanges.

In the design of such gas turbines, in addition to the achievable power, a particularly high efficiency is customarily a design aim. An increase of the efficiency can basically be achieved in this case, for thermodynamic reasons, by an increase of the discharge temperature at which the operating medium flows out of the combustion chamber and flows into the turbine unit. In this case, temperatures of about 1200° C. to 1500° C. are aimed at, and also achieved, for such gas turbines.

Such high temperatures of the operating medium, however, lie far above the melting temperature of the component materials which are used in the discharge region of the combustion chamber, for example, so that the critical components have to be intensely cooled and protected with complex coating systems for ensuring the necessary function of the gas turbine. In this case, it cannot be excluded occasionally that despite application of these highly developed and frequently tested technologies for cooling and coating the blades a premature exchange of stator blades becomes necessary since the blade function, as result of partial loss of the coating or closing off of cooling air holes, for example, is impermissibly impaired.

In the case of large stationary gas turbines, such an exchange measure can last at best several days, but on average about two weeks, so that as a result an undesired and expensive interruption of the operation of the gas turbine or of a gas and steam turbine power plant, in which the gas turbine is used, is brought about.

A stator blade ring for a turbomachine is known from U.S. Pat. No. 3,300,180. The stator blade ring comprises a stator blade carrier which consists of two clamping rings which in each case are assembled from two 180° large segments. Stator blade segments are clamped between the two clamping rings, forming a stator blade ring. In this case, the stator blade segments are further stabilized on their inner end by means of an inner ring.

It is disadvantageous, however, that for removal of a stator blade segment which is to be exchanged the one or both segment(s) of one of the two clamping rings has or have to be completely removed. This is associated with increased time consumption and greater space requirement.

Furthermore, a turbine stator blade carrier, which extends over the entire axial length of the turbine unit, is known from US 2005/0132707 A1. This is then of a multiply segmented construction in the circumferential direction.

SUMMARY OF INVENTION

The invention is therefore based on the object of disclosing a turbine stator blade carrier, especially for a gas turbine, which while maintaining particularly high efficiency, also enables a particularly simple exchange of individual stator blades and therefore is designed for a particularly short repair duration.

This object is achieved according to the invention by the turbine stator blade carrier being designed according to the features of the claims.

The invention in this case is based on the consideration that a curtailed repair duration would be possible as a result of a particularly simple exchangeability of the stator blades if their installation and removal could be simplified. At present, specifically on account of the constructional circumstances in modern stationary annular combustion chamber machines, the turbine has to be opened up in order to enable access to its stator blades. In this case, the stator blades lie within the stator blade carrier which in the case of stationary gas turbines consists of an upper and a lower solid cast part, and therefore also has to be disassembled for exchange of the stator blades. In order to avoid this opening up and lifting the upper cast part of the stator blade carrier, the stator blade carrier should therefore be multiply segmented in at least one section. By the use of more than two segments in this section, these are smaller than the remaining segments. As a result, just by lifting individual segments it is possible to reach the region which is surrounded by them. In order to also ensure reachability of the stator blades in the process one segment should extend in this case over the entire radial extent of the stator blade carrier and the connection of the respective segment to the remaining stator blade carrier should be releasable. Therefore, for a repair or an exchange of an individual stator blade of the first turbine stage the upper cast part of the stator blade carrier no longer has to be lifted but only the connection of the respective segment to the remaining section of the stator blade carrier and to circumferentially adjacent segments is released, as a result of which—since the segment in question extends over the entire radial extent of the stator blade carrier—a direct reaching of the radially further inwardly disposed stator blades and their exchange is possible after removal of the respective segment.

The highest temperatures in the gas turbine exist at the exit of the combustion chamber. Therefore, the stator blade of the first turbine stage, i.e. the stator blade which lies closest to the combustion chamber, is exposed to these extremely high temperatures and is subjected to the greatest wear. Accordingly, a premature exchange as a result of damage due to blockage of the cooling air holes (for example as a result of cooling air holes oxidizing up on the inside) is particularly to be expected in the case of this turbine stator blade. In order to also simplify in particular the exchange of these stator blades individually, the stator blade carrier should therefore advantageously be multiply segmented in the section of the stator blade row which lies closest to a combustion chamber of the gas turbine. In other words, the inflow-side section of the turbine stator blade carrier should have more segments than the remaining section of the turbine stator blade carrier.

In order to achieve a reachability of all the stator blades of a stator blade row, provision should be made for such a number of segments that each segment can be handled by one or, in the worst case, two fitters. Therefore, in each circumferential section an exchange of stator blades can be carried out by only the respective segment radially outside the affected stator blade being removed. In this case, the accurate geometric design of the segmentation should be adapted in a practical manner to the handling of the machine.

In a further advantageous development, the respective connection between axially adjacent segments is a screwed connection and/or a tongue-in-groove connection. By screws, a particularly simple releasable connection of segments to each other and/or to the remaining stator blade carrier is possible. As a result of the circular arrangement of the segments around the entire circumference, however, a hook-in fastening in the style of a tongue-in-groove connection is also possible, in which the individual segments are only screwed to each other and only hooked into the rest of the stator blade carrier. In this way, a particularly simple removal and installation of the individual segments is possible.

In order to further simplify the removal of the stator blades which can now be reached as a result of the segmentation of the stator blade carrier, the stator blade fixing of a gas turbine should be provided in a practical manner in such a way that an uninterrupted removal of any segment lying on the circumference is ensured so that depending upon the position of the blade which is to be replaced only the affected, radially further outwardly disposed segment has to be removed. To this end, in an advantageous development the stator blade of the respective stator blade row is releasably connected to one of the segments of the remaining section. Consequently, after removal of the affected segment the stator blade can be withdrawn by releasing the connection to the segment of the section. The segments which are located in the inflow-side section therefore do not serve for the fastening of stator blades but only for establishing or maintaining the integrity of the gas turbine and, if applicable, for the separation of chambers for cooling air at different pressures and/or temperatures.

In order to enable a simple removal of the stator blade in a gas turbine not only on the blade root side but also on the blade tip side of the respective stator blade, the stator blade of the respective stator blade row, on its side facing the turbine axis, is advantageously releasably connected in the radial direction to an inner ring. Therefore, a radial removal of the stator blade is possible. This allows a particularly simple exchange as a result.

A particularly simple exchange of the stator blade is possible by the fixing of the stator blade on the inner ring being designed as a simple push-in connection. To this end, the respective stator blade advantageously includes a tongue which can be pushed into a groove of the inner ring in the radial direction. As a result, for exchanging the respective stator blade the blade root-side connection of the stator blade to the remaining stator blade carrier can simply be released and the respective stator blade can simply be withdrawn from the turbine in the radial direction by releasing the push-in connection. In this case, as a result of the blade root-side fixing of the stator blade on the stator blade carrier, adequate security is also ensured during operation.

In the previous type of construction, the stator blades of a stator blade row were fixed on the inner ring via a connection secured with pins so that for disassembly the entire inner ring had to be removed and the stator blades could then be withdrawn. With a releasable connection, for example in the style of a simple push-in connection of the stator blades to the inner ring, the inner ring should therefore be fixed to the combustion chamber hub, i.e. to a component which is connected to the combustion chamber and therefore to the static part of the gas turbine. To this end, the inner ring is advantageously connected to a combustion chamber hub. This can be carried out by a fixing by welding, clamping, or the like, for example. In the case of the new construction of a gas turbine, the inner ring can also be produced directly as a component part of the combustion chamber hub.

Between the individual stator blades, provision is made both on the blade root and on the blade tip in the previous type of construction for grooves in which sealing plates are arranged between the stator blades in the circumferential direction. If, however, the stator blades are to be removed individually, the sealing plates which lie in the grooves of stator blade root and stator blade tip block the stator blades, however, and can therefore possibly hinder the removal. Therefore, the fixing of the sealing plates should be modified in such a way that their removal is possible and therefore removal of individual stator blades is simplified. For this purpose, stepped edges, in which the sealing plate is fixed by means of a clamping element, are advantageously introduced on the sides of the blade root and/or blade tip facing the adjacent stator blade in each case. Before removal of the stator blades, therefore, the clamping element can be released and the sealing plate can be removed so that a particularly simple removal of the stator blade is possible.

In an advantageous development, such a turbine stator blade carrier is used in a gas turbine. In order to enable a particularly simple reachability of the stator blade for exchanging individual stator blades, an outer casing of the gas turbine in this case advantageously includes a manhole through which simple access to the segments of the stator blade carrier for service personnel is possible.

A gas and steam turbine power plant advantageously comprises such a gas turbine.

The advantages which are achieved with the invention are especially that as a result of the different segmentation of the stator blade carrier in the inflow-side section and in at least one remaining section, those stator blades which are encompassed by the inflow-side segments and supported by the remaining section in the process can be released after removing a respective inflow-side segment from the remaining stator blade carrier. As a result, a particularly simple exchange of stator blades of a stator blade row becomes possible since the outer casing of the turbine and the upper cast half of the turbine stator blade carrier do not have to be lifted from the rest of the gas turbine during such an exchange. The fitters who carry out the exchange of the stator blades can therefore exchange the stator blades in the gas turbine with the outer casing closed, which significantly reduces the cost for exchanging the stator blades and can considerably reduce the necessary downtime of the gas turbine. Such a simplified exchange especially of the first stator blade stage directly downstream of the combustion chamber also enables an increase of the exit temperature in conjunction with an increase of the efficiency of the gas turbine since as a result of the simplified exchangeability of the stator blades less consideration has to be made for their durability. In this case, variable exchange concepts are conceivable during operation. Furthermore, such a construction, as result of the simplified exchange, enables a comparatively quicker test of new prototypes of stator blades, for example with new types of coating or new cooling concepts, in research and development.

BRIEF DESCRIPTION OF THE DRAWINGS

An exemplary embodiment of the invention is explained in more detail with reference to a drawing. In the drawing.

Like components are provided with the same designations in all the figures.

DETAILED DESCRIPTION OF INVENTION

Figure 1:
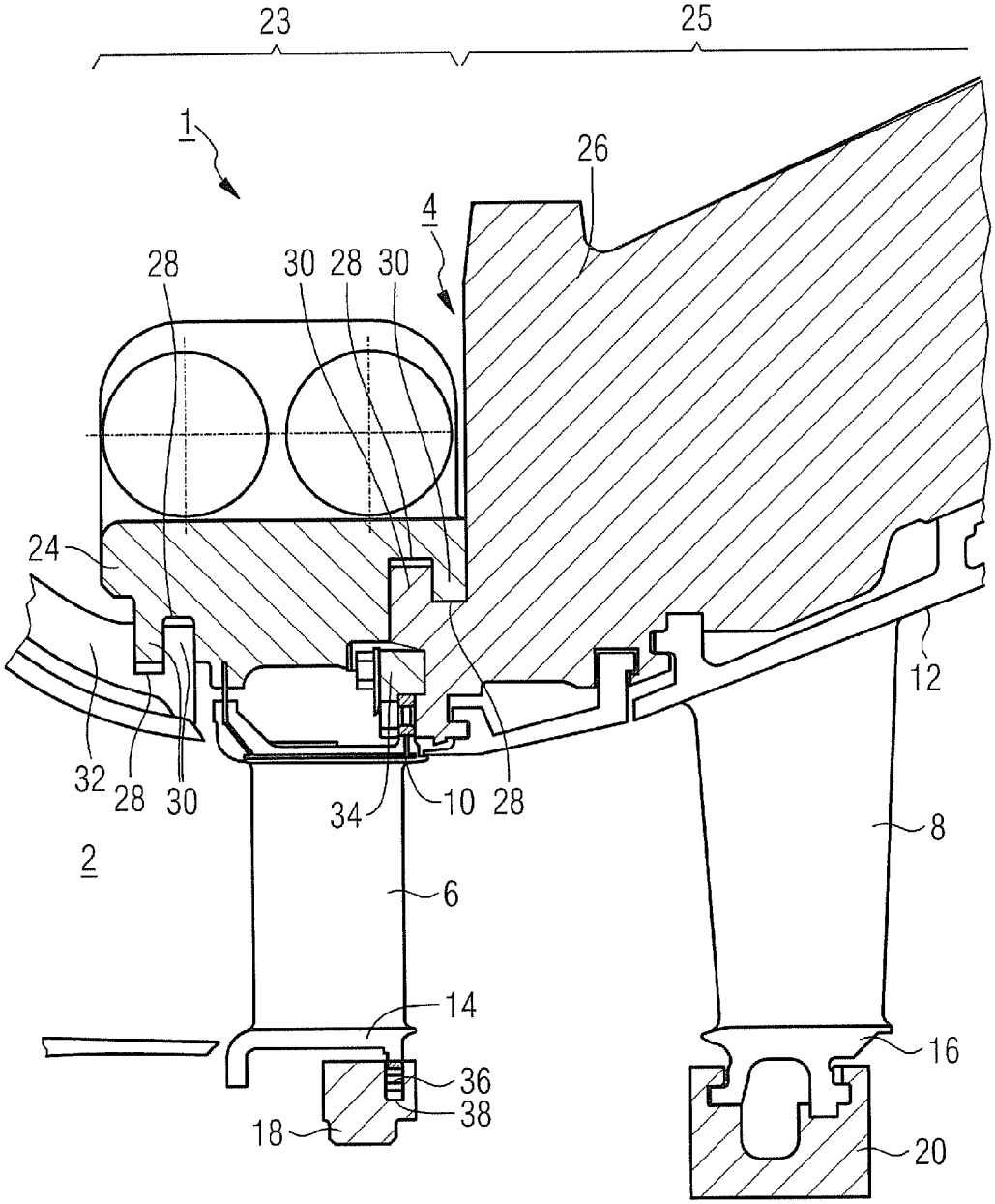
FIG. 1 shows a stator blade system, with hook-in fastened segments, in longitudinal section.

FIG. 1 shows a turbine stator blade carrier 1—also just called a stator blade carrier—in detail in the region of the first two stator blade rows which follow a combustion chamber 2 in the hot gas direction. The view shows in this case a half-section through the upper half 4 of a conically formed stator blade carrier and also the stator blades 6 of the first turbine stage and stator blades 8 of the second turbine stage which are arranged in each case at the apex of the stator blade ring.

The stator blades 6, 8 in this case each comprise a blade root 10, 12 and also a blade tip 14, 16, via which their fastening on the remaining components is carried out. The stator blades 6, 8 of the first and second turbine stage in this case are fastened by their blade roots 10, 12 on the stator blade carrier 1 and by their respective blade tips 14, 16 are fixed on inner rings 18, 20. In this case, both the inner ring 20 and the stator blade carrier 1 comprise a large number of cooling systems which ensure a cooling air feed to the stator blade carrier 1, to the stator blades 6, 8 and to the inner ring 20 in order to adequately cool these components on account of the high hot gas temperatures.

The highest temperatures occur in this case at the exit of the combustion chamber 2 which is why the stator blades 6 of the first stator blade row are exposed to the highest temperatures. As a result, despite all the cooling measures, damage to the stator blades 6, and a premature exchange of these stator blades 6 which is necessary as a result, cannot be excluded. In order to now enable a particularly simple exchange of the stator blades 6, the stator blade carrier 1 is multiply segmented in the region of the first stator blade row.

The stator blade carrier 1, in an inflow-side section 23, comprises a number (in this case 12 pieces, cf. FIG. 3) of segments 24, and in a remaining section 25 comprises a stator blade carrier 1 which is segmented only into two halves 26. All the segments 24, 26 are releasably interconnected. In FIG. 1, the connection between the segments 24 of the inflow-side section 23 and the segments 26 of the remaining section 25 is realized in this case via a hook-in fastening by means of grooves 28 and tongues 30 which are introduced into the segments 24 and the segments 26. An exactly identical connection of the segments 24 to the combustion chamber wall 32 is provided in order to separate a radially further outwardly lying chamber from the stator blades 6 and to enable the connection between combustion chamber 2 and remaining segments 26 which is necessary for the stability and rigidity of the gas turbine.

An upper and a lower half of a stator blade carrier, which is annular in cross section, as is already known in the case of statically installed gas turbines, is understood as the remaining stator blade carrier. In this case, two segments 26 are provided in the remaining section 25 of the stator blade carrier 1. In this respect, more segments 24 are always provided in sections for the circumference than remaining segments 26.

As a result of the hook-in fastening, the connection of the respective segments 24 to the remaining segment 26 can be released and the segment 24 can be withdrawn in the radial direction. Therefore, the stator blades 6 of the first turbine stage can be reached from the outside without complete opening up of the entire turbine. The stator blade 6 of the first turbine stage is releasably fastened via the blade root 10 on the remaining segment 26 by means of a fastening device 34. After removal of the segment 24, this connection can be released and the stator blade 6 can be withdrawn in the radial direction. The blade tip 14 of the stator blade 6 of the first turbine stage in this case includes a tongue 36 which is pushed in a groove 38 of the inner ring 18. The fastening on the inner ring 18 is therefore designed simply as a push-in connection so that the stator blade 6 can be simply withdrawn outwards after releasing the fastening device 34.

Figure 2:
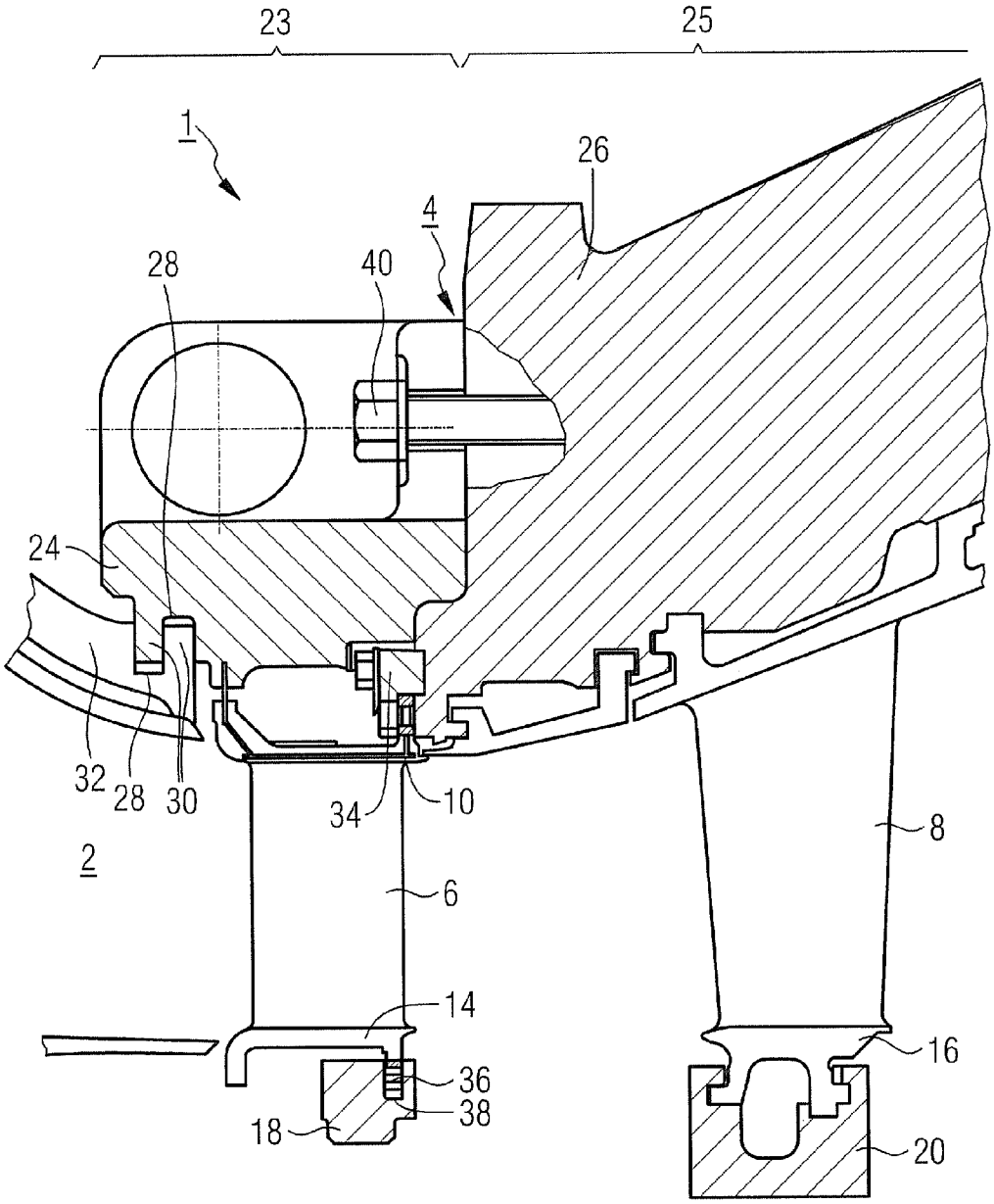
FIG. 2 shows a stator blade system, with screwed segments, in longitudinal section.

FIG. 2 also shows the stator blade system 1 as in FIG. 1, but in this case the releasable connection of the segment 24 on the remaining segment 26 is realized via a screw 40. The hook-in fastening of the segment 24 to the combustion chamber wall 32 via grooves 28 and tongues 30 is unaltered in this case. Such a connection with a screw 40 may be desirable depending upon rigidity requirements or geometric requirements in the stator blade carrier 1.

Figure 3:
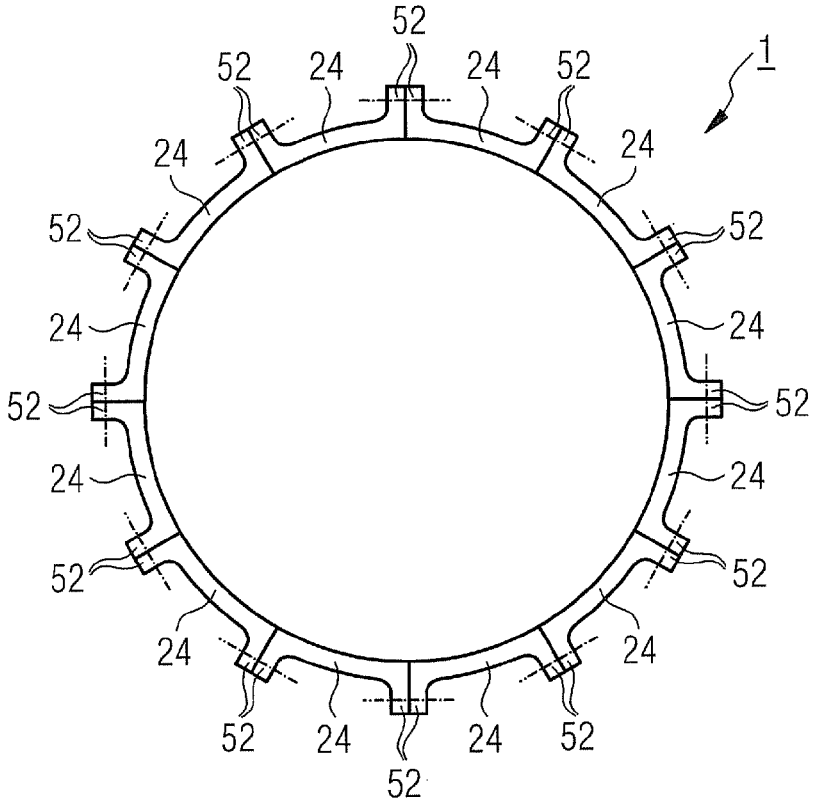
FIG. 3 shows a cross section through the segments perpendicularly to the turbine axis.

FIG. 3 now shows a section, lying perpendicularly to the turbine axis 1, through the stator blade carrier 1 at the level of the segments 24. In the depicted example, provision is made for altogether twelve segments 24 which via flanges 52 are connected by a screwed connection, for example. As a result, a secure retention of the multiply segmented section 23 of the stator blade carrier 1 is ensured, even if the individual segments 24 are connected only via a hook-in fastening to the remaining segment 26, as shown in FIG. 1. The segmentation can also be created in another way, however, and can be correspondingly adapted to the handling of the machine.

Figure 4:
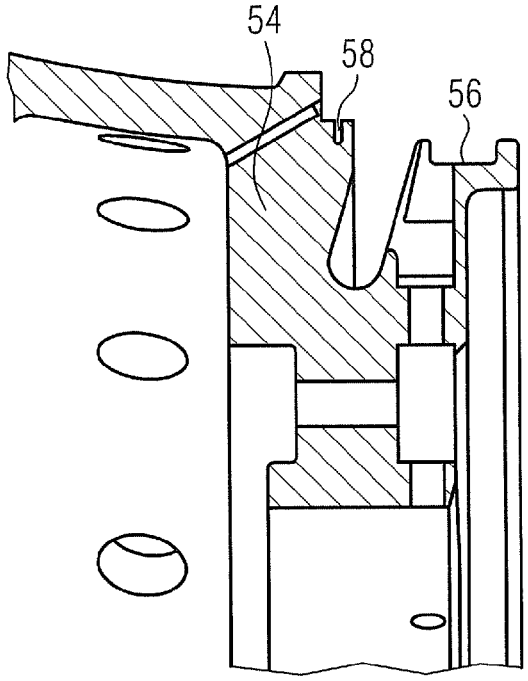
FIG. 4 shows a combustion chamber hub of an annular combustion chamber.

FIG. 4 shows the combustion chamber hub 54 of a gas turbine. This includes a groove 56 into which is inserted the inner ring 18 which is shown in FIGS. 1 and 2. Furthermore, provision is made for a groove 58 in which a sealing plate is provided for sealing the gap between blade root 14 of the stator blade 6 of the first turbine stage and the combustion chamber hub 54.

Figure 5:
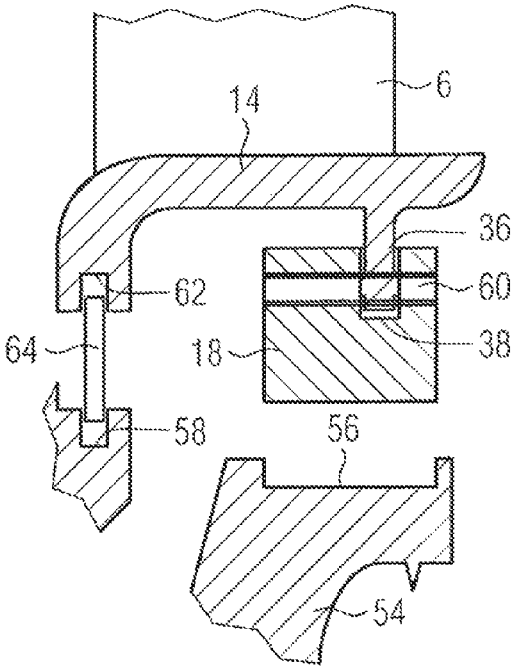
FIG 5 Prior art
FIG. 5 shows the blade tip-side fixing of the stator blade according to the prior art.

FIG. 5 shows a known fastening of the stator blade root 14 on the combustion chamber hub 54 of the gas turbine in detail. In this case, the blade root 14 includes a tongue 36 which is inserted into a groove 38 of the inner ring 18. The stator blade 6 of the first turbine stage is fixed there by means of a pin 60. The inner ring 18 is then inserted into the groove 56 of the combustion chamber hub 54. At the same time, the blade root 14 includes a groove 62 for accommodating a sealing plate 64 which also lies in the groove 58 of the combustion chamber hub 54.

Figure 6:
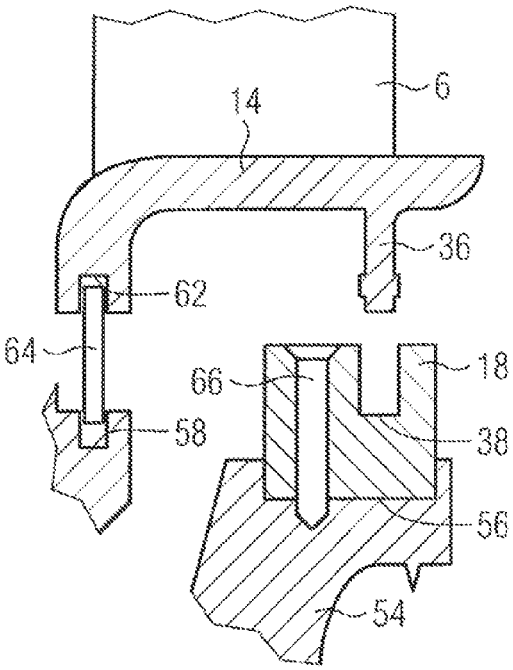
FIG. 6 shows the blade tip-side fixing of the stator blade with a push-in connection.

Since the pin 60 extends parallel to the turbine axis, a complete removal of the inner ring 18 has been necessary up to now for removal of the stator blade 6 of the first turbine stage. Only after removal of the inner ring can the pin 60 be removed and the stator blade 6 withdrawn. Therefore, the connection of the stator blade 6 to the combustion chamber hub 54 is now realized as shown in FIG. 6:

The tongue 36 of the blade root 14 is now no longer connected via a pin to the inner ring 18 in its groove 38 but is only pushed onto the inner ring 18. Instead, the inner ring 18 is fastened on the combustion chamber hub 54 by means of a pin 66 or a screw. As a result, the stator blades 6 can also be removed individually without disassembling the inner ring 18. A secure retention of the stator blades 6 is still ensured in this case via the fastening device 34, as shown in FIGS. 1 and 2.

Figure 7:
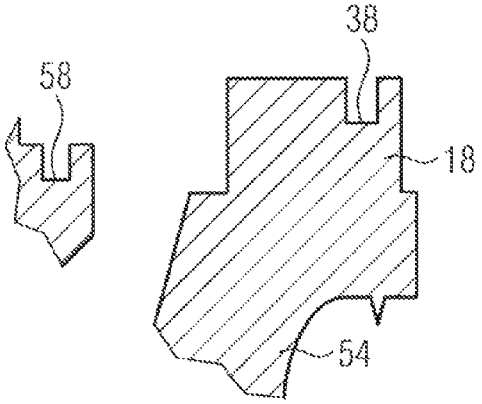
FIG. 7 shows a combustion chamber hub with the inner ring as a component part.

In such an embodiment, it is also possible to produce the inner ring 18 directly as a component part of the combustion chamber hub 54. As a result, separate parts are no longer necessary. Such a development is shown in FIG. 7.

Figure 8:
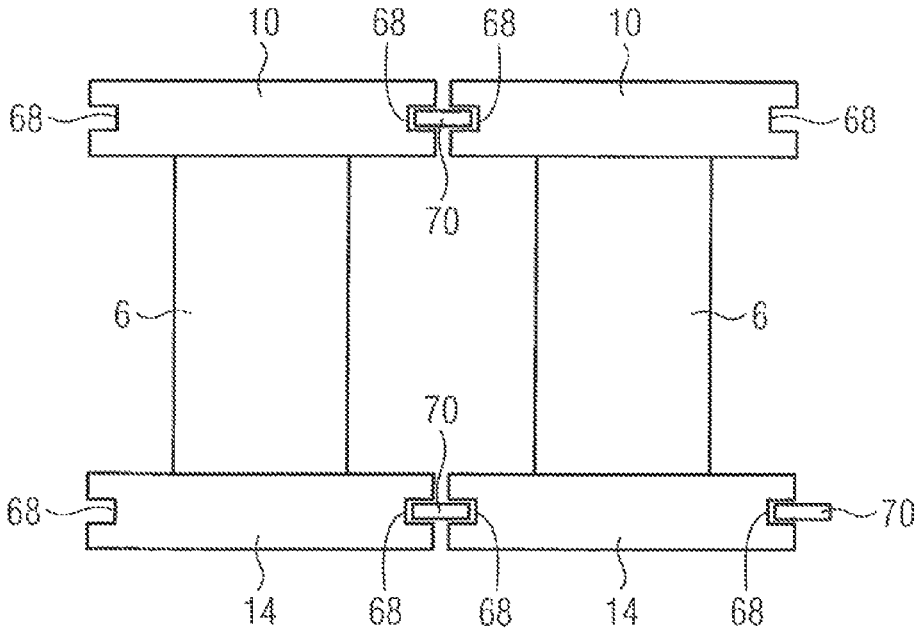
FIG 8 Prior art
FIG. 8 shows a cross section through two adjacent stator blades perpendicularly to the turbine axis with sealing elements fixed in grooves, according to the prior art.

FIG. 8 shows a section perpendicularly to the turbine axis through two adjacent stator blades 6 of the first turbine stage, as customary according to the prior art. In this case, grooves 68 are introduced into the blade roots 10 and blade tips 14 on the face pointing to the adjacent stator blade 6 in each case, into which grooves are inserted sealing plates 70 which close off the gaps between the blade roots 10 and blade tips 14. These sealing plates 70, however, can be a hindrance during a radial withdrawal of individual stator blades 6.

Consequently, a plurality of stator blades 6 are first to be unlocked and shifted in the circumferential direction so that one stator blade 6 disengages from the sealing plates 70 and can be removed in the radial direction.

Figure 9:
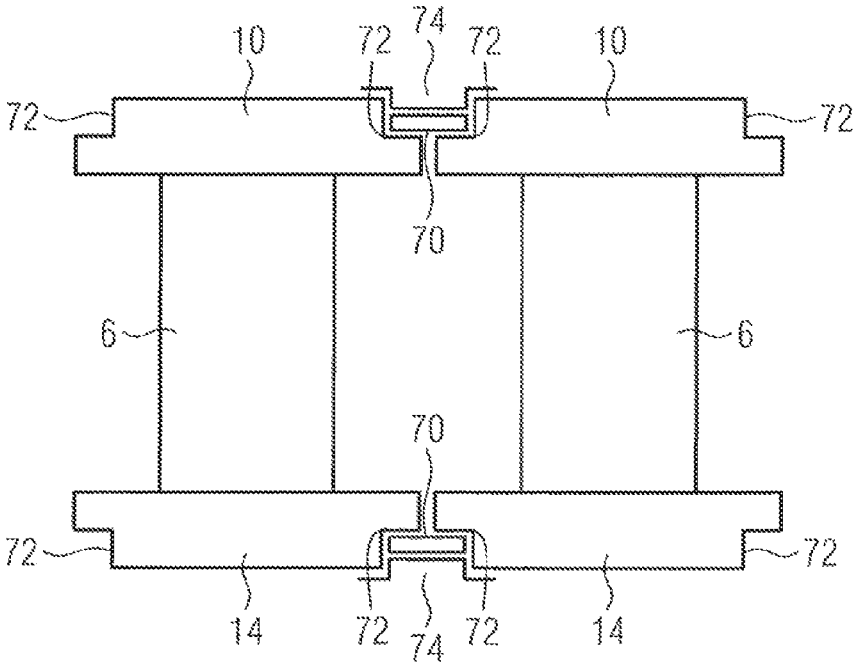
FIG. 9 shows a section through two adjacent stator blades perpendicularly to the turbine axis with sealing elements fixed by clamping elements.

In order to avoid this, as shown in FIG. 9, the grooves 68 are replaced by stepped edges 72. The sealing plates 70 are now inserted into the stepped edges 72 and secured there by means of clamping elements 74. For removal of an individual stator blade 6, the clamping element 74 can now be released first and the sealing element 70 can be removed. The stator blade 6 can then be withdrawn in the radial direction. Therefore, an exchange of individual stator blades is made significantly easier.

Such a stator blade system 1 which is described here is advantageously used in a gas turbine 101.

Figure 10:
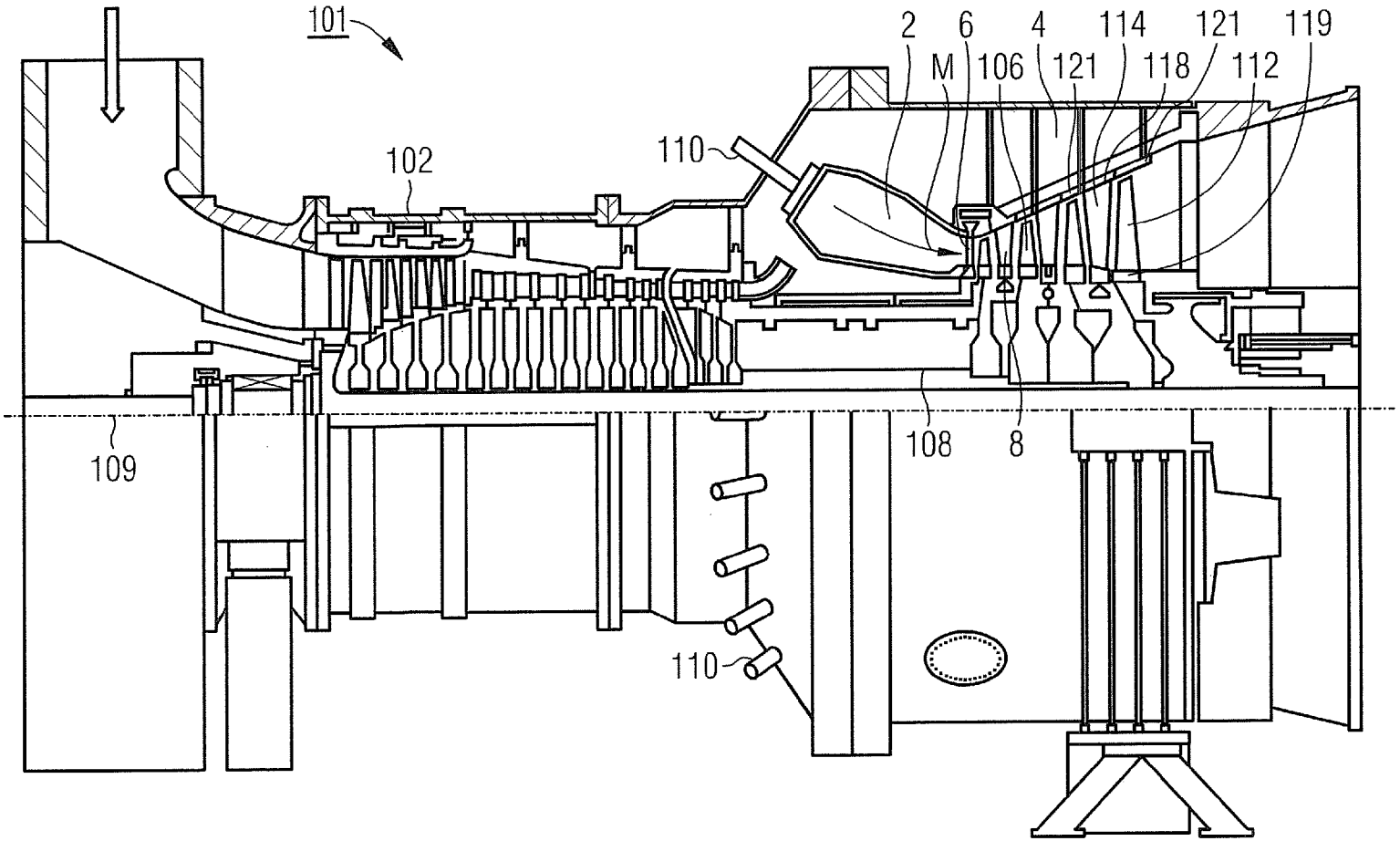
FIG. 10 shows a half-section through a gas turbine.

A gas turbine 101, as shown in FIG. 10, has a compressor 102 for combustion air, a combustion chamber 2 and also a turbine unit 106 for driving the compressor 102 and for driving a generator or a driven machine, which is not shown. To this end, the turbine unit 106 and the compressor 102 are arranged on a common turbine shaft 108 which is also referred to as a turbine rotor to which the generator or the driven machine is also connected, and which is rotatably mounted around its center axis 109. The combustion chamber 2 which is constructed in the style of an annular combustion chamber is equipped with a number of burners 110 for combusting a liquid or gaseous fuel.

The turbine unit 106 has a number of rotatable rotor blades 112 which are connected to the turbine shaft 108. The rotor blades 112 are arranged on the turbine shaft 108 in a ring-like manner and therefore form a number of rotor blade rows. Furthermore, the turbine unit 106 comprises a number of fixed stator blades 6, 8, 114 which are also fastened in a ring-like manner on a stator blade carrier 1 of the turbine unit 106, forming stator blade rows.

The rotor blades 112 in this case serve for driving the turbine shaft 108 as a result of impulse transfer from the operating medium M which flows through the turbine unit 106. The stator blades 6, 8, 114 on the other hand serve for flow guiding of the operating medium M between two consecutive rotor blade rows or rotor blade rings in each case, as seen in the flow direction of the operating medium M. A consecutive pair, consisting of a ring of stator blades 114 or a stator blade row and a ring of rotor blades 112 or a rotor blade row, in this case is also referred to as a turbine stage.

Each stator blade 114 has a blade root 118 which, for fixing of the respective stator blade 114 on a stator blade carrier 1 of the turbine unit 106, is arranged as a wall element. Each rotor blade 112 is fastened in a similar way on the turbine shaft 108 via a blade root 119.

Between the platforms 118—which are arranged in a spaced apart manner—of the stator blades 114 of two adjacent stator blade rows, a ring segment 121 is arranged in each case on the stator blade carrier 1 of the turbine unit 106. The outer surface of each ring segment 121 in this case is at a distance in the radial direction from the outer end of the rotor blades 112 lying opposite it by means of a gap. The ring segments 121 which are arranged between adjacent stator blade rows in this case especially serve as cover elements which protect the inner casing in the stator blade carrier 1 or other installed components of the casing against thermal overstress as a result of the hot operating medium M which flows through the turbine 106.

The combustion chamber 2 in the exemplary embodiment is designed as a so-called annular combustion chamber in which a multiplicity of burners 110, which are arranged around the turbine shaft 108 in the circumferential direction, lead into a common combustion chamber space. For this, the combustion chamber 2 in its entirety is designed as an annular structure which is positioned around the turbine shaft 108.

By using a turbine stator blade carrier 1 of the design which is specified above in such a gas turbine 101, a considerably simplified repair can be achieved with high efficiency of the gas turbine 101 at the same time as a result of a significantly simpler exchangeability of individual stator blades 6, especially of the first turbine stage.

The invention claimed is:

1. A turbine stator blade carrier, comprising:

a first plurality of segments;

a second plurality of segments; and at least two interconnected sections along an axial extent, wherein the turbine stator blade carrier is configured to carry a row of stator blades of a gas turbine where the stator blades are disposed radially inward of the turbine stator blade carrier with respect to the turbine axis, wherein one segment of the first plurality of segments extends over an entire radial extent of the turbine stator blade carrier such that a direct reaching of the radially further inwardly disposed stator blades and their exchange is possible after removal of the one segment and a connection of the respective segment to an adjacent segment is releasable, and wherein the at least two interconnected sections comprise a first section and a second section, wherein the first section and the second section include the first plurality of segments and the second plurality of segments, respectively, wherein the first plurality of segments and the second plurality of segments include a different number of segments, wherein the at least two interconnected sections include an inflow-side section and a remaining section, and wherein the inflow-side section includes a greater number of segments than the remaining section, wherein the remaining section includes, on a side facing the inflow-side section, a radially outwardly protruding projection that is encompassed by the first plurality of segments of the inflow-side section in a radial direction.

2. The turbine stator blade carrier as claimed in claim 1, wherein the connection between axially adjacent segments is a screwed connection or a tongue-in-groove connection.

3. The turbine stator blade carrier as claimed in claim 1, wherein the stator blade carrier is provided in a stationary gas turbine.

4. A gas turbine with a turbine stator blade carrier as claimed in claim 1, the gas turbine, comprising:

a row of stator blades which are releasably fastened on the second plurality of segments of the remaining section, wherein a stator blade of the respective stator blade row includes a side facing a turbine axis where the stator blade is releasably connected to an inner ring, and wherein which each stator blade is fastened on the projection.

5. The gas turbine as claimed in claim 4, wherein the respective stator blade includes a tongue which is pushed into a groove of the inner ring in the radial direction.

6. The gas turbine as claimed in claim 4, wherein the inner ring is connected to a combustion chamber hub.

7. The gas turbine as claimed in claim 4, wherein the first plurality of segments which are provided in the inflow-side section are connected to a combustion chamber wall.

8. The gas turbine as claimed in claim 4, wherein a sealing plate is provided between adjacent stator blades of the respective stator blade row, and wherein a plurality of stepped edges, in which the sealing plate is fixed by means of a clamping element, are introduced on a plurality of sides of a blade root and/or a blade tip facing the adjacent stator blade in each case.

9. The gas turbine as claimed in claim 4, wherein the connection between axially adjacent segments is a screwed connection or a tongue-in-groove connection.

* * * * *